US012723358B2

(12) United States Patent
Yang et al.

(10) Patent No.: US 12,723,358 B2
(45) Date of Patent: Sep. 1, 2026

(54) SOCKET ASSEMBLED ARCH RIB, MANUFACTURING AND CONSTRUCTION METHOD THEREOF, AND ARCH BRIDGE

(71) Applicant: SHANDONG UNIVERSITY, Jinan (CN)

(72) Inventors: Zeying Yang, Jinan (CN); Li Tian, Jinan (CN); Youzhi Wang, Jinan (CN); Yinglin Sun, Jinan (CN); Zhilin Qu, Jinan (CN); Rongrong Duan, Jinan (CN); Chenghe Wang, Jinan (CN); Weisong Qu, Jinan (CN); Qianyi Yang, Shandong (CN); Jianbo Qu, Jinan (CN); Zhengquan Cheng, Jinan (CN); Chuanlong Bi, Jinan (CN); Rui Sun, Jinan (CN); Jie Liu, Jinan (CN); Guangtong Zhou, Jinan (CN)

(73) Assignee: SHANDONG UNIVERSITY, Jinan (CN)

( * ) Notice: Subject to any disclaimer, the term of this patent is extended or adjusted under 35 U.S.C. 154(b) by 436 days.

(21) Appl. No.: 18/009,825

(22) PCT Filed: Mar. 16, 2022

(86) PCT No.: PCT/CN2022/081231
§ 371 (c)(1),
(2) Date: Jan. 12, 2024

(87) PCT Pub. No.: WO2023/123691
PCT Pub. Date: Jul. 6, 2023

(65) Prior Publication Data

US 2024/0240416 A1 Jul. 18, 2024

(30) Foreign Application Priority Data

Dec. 31, 2021 (CN) ..... 202111678283.1

(51) Int. Cl.
*E01D 19/00* (2006.01)
*E01D 4/00* (2006.01)
*E01D 101/26* (2006.01)

(52) U.S. Cl.
CPC ..... *E01D 19/00* (2013.01); *E01D 4/00* (2013.01); *E01D 2101/268* (2013.01)

(58) Field of Classification Search
CPC ..... E01D 4/00; E01D 19/00; E01D 2101/268
See application file for complete search history.

(56) References Cited

U.S. PATENT DOCUMENTS 6,205,605 B1 3/2001 Orsat
7,546,656 B2 * 6/2009 Kim ..... E01D 2/00 14/77.3
8,479,473 B2 * 7/2013 Gutierrez ..... E04B 1/3205 52/745.07

FOREIGN PATENT DOCUMENTS

CN 202055263 U 11/2011
CN 102359070 A 2/2012
(Continued)

OTHER PUBLICATIONS

Sep. 28, 2022 International Search Report Issued in International Patent Application No. PCT/CN2022/081231.
(Continued)

*Primary Examiner* — Gary S Hartmann
(74) *Attorney, Agent, or Firm* — Oliff PLC

(57) ABSTRACT

A socket assembled arch rib and an arch bridge including at least one first monomer, the first monomer includes an inner and outer tube snapped outside the inner tube, a first end of the inner tube protrudes from a first end of the outer tube to form a convex part, a second end is located in the outer tube, the outer tube is filled with concrete, and concrete forms a concave part at a second end of the outer tube for socketing the convex part of the other first monomer; for unfilled
(Continued)

concrete area inside the CFST structure arch rib, a double-layer CFST monomer with convex and concave parts formed respectively at the end, and the adjacent monomers are connected with each other through the socket-fit of the convex and concave parts.

10 Claims, 3 Drawing Sheets

(56) References Cited

FOREIGN PATENT DOCUMENTS

| | | | | | |
|---|---|---|---|---|---|
| CN | 202659250 | U | | 1/2013 | |
| CN | 106835936 | A | * | 6/2017 | ..... E21D 11/003 |
| CN | 106835937 | A | * | 6/2017 | ..... E01D 4/00 |
| CN | 106835998 | A | * | 6/2017 | ..... E01D 4/00 |
| CN | 106917470 | A | | 7/2017 | |
| CN | 106996077 | A | * | 8/2017 | ..... E01D 4/00 |
| CN | 107142834 | A | * | 9/2017 | ..... E01D 4/00 |
| CN | 206635632 | U | | 11/2017 | |
| CN | 107806010 | A | | 3/2018 | |
| CN | 208137969 | U | | 11/2018 | |
| CN | 109853364 | A | | 6/2019 | |
| CN | 210217774 | U | | 3/2020 | |
| CN | 111395147 | A | * | 7/2020 | ..... E01D 4/00 |
| CN | 211498444 | U | | 9/2020 | |
| CN | 111877130 | A | * | 11/2020 | ..... E01D 4/00 |
| CN | 212983937 | U | | 4/2021 | |
| CN | 112832825 | A | | 5/2021 | |
| CN | 112982137 | A | * | 6/2021 | ..... E01D 4/00 |
| CN | 113215956 | A | | 8/2021 | |
| CN | 113718623 | A | | 11/2021 | |
| CN | 113774780 | A | | 12/2021 | |
| CN | 116463944 | A | * | 7/2023 | ..... E01D 21/00 |
| CN | 116676853 | A | * | 9/2023 | ..... E01D 19/00 |
| JP | 2002-089197 | A | | 3/2002 | |
| JP | 2002-201609 | A | | 7/2002 | |
| KR | 20060011598 | A | * | 2/2006 | ..... E01D 19/02 |
| WO | 2017/047984 | A1 | | 3/2017 | |

OTHER PUBLICATIONS

Sep. 28, 2022 Written Opinion of the International Searching Authority for International Patent Application No. PCT/CN2022/081231.

Jul. 5, 2022 Office Action Issued in Chinese Patent Application No. 202111678283.1.

* cited by examiner

SOCKET ASSEMBLED ARCH RIB, MANUFACTURING AND CONSTRUCTION METHOD THEREOF, AND ARCH BRIDGE

CROSS-REFERENCES TO RELATED APPLICATIONS

This application claims priority benefits to Chinese Patent Application No. 202111678283.1, filed 31 Dec. 2021, the contents of which are incorporated herein by reference.

TECHNICAL FIELD

The present invention relates to a bridge technical field, specifically to a socket assembled arch rib, manufacturing and construction method thereof, and an arch bridge.

BACKGROUND

Concrete-filled Steel Tubular (CFST) arch bridge is one of the steel-concrete composite structures. The CFST arch bridge is filled with concrete inside the steel tube, which limits the expansion of the concrete under pressure due to the radial restraint of the steel tube, so that the concrete is in a three-way pressure state, thus significantly improving the compressive strength of the concrete. At the same time, the steel tube has the role of both longitudinal reinforcement and transverse hoop, and can be used as construction formwork to facilitate concrete placement. During construction, the steel tube can be used as a strong load-bearing skeleton, with simple welding work and light lifting weight, which can simplify the construction process and shorten the construction period.

The traditional construction technique of the CFST arch bridge is to pump concrete into the steel tube from the lower end of the main arch after the arch rib is completed, wherein the arch rib is closed in the ring direction and invisible, it is difficult to check whether the concrete is filled with the steel tube, meanwhile, the on-site construction is complex; some testing equipment can detect whether the inside of arch rib steel tube is filled with concrete, but during the testing process, the concrete continues to solidify, makes the fluidity of concrete inside the steel tube decrease, and the hardness increase; even if the unfilled area can be found, it is difficult to supplement the unfilled area. However, adopting a vibration method will damage the steel tube structure and affect the bearing capacity of the steel tube; and, adopting a method of drilling, grouting, and then repairing on the unfilled area will affect the bearing capacity of the arch rib steel tube structure, and the strength of the arch rib steel tube will be reduced after multi-point drilling, which is difficult to meet the stress requirements of the arch bridge.

SUMMARY

Aiming at the defects existing in the prior art, a purpose of the present invention is to provide a socket assembled arch rib, manufacturing and construction method thereof, and an arch bridge, using a double-layer CFST monomer with a convex part and a concave part respectively formed at the end, and the adjacent monomers are connected by the convex part and the concave part of the mating socket, which is convenient for the sub-monomers to fill the concrete in the steel tube, ensure the concrete filling is dense, reduce the unfilled area, and ensure the strength of the CFST arch rib.

A first object of the present invention is to provide a socket assembled arch rib, adopting the following technical solution:

comprising at least one first monomer, the first monomer comprises an inner tube and an outer tube snapped outside the inner tube, a first end of the inner tube protrudes from a first end of the outer tube to form a convex part, a second end of the inner tube is located in the outer tube, the outer tube is filled with concrete, and the concrete forms a concave part at a second end of the outer tube for socketing the convex part of the other first monomer.

Further, a cross-section of the concave part along a radial direction of the outer tube is the same as a cross-section of a radial direction of the inner tube, and the concave part fits the convex part to limit rotation of the inner tube about an axis thereof.

Further, a space is provided between the inner tube in a circumferential direction and the outer tube, and a connecting piece is provided within the space to maintain a relative position of the inner tube and the outer tube.

Further, the inner tube is filled with concrete and the space between the inner tube and the outer tube is filled with concrete.

Further, at least one end of the inner tube is provided with an anchor member, a first end of the anchor member being located inside the inner tube and a second end extending outside the inner tube.

Further, a plurality of first monomers are connected through a web member on a side surface of the monomer to form an arch rib segment, and end faces of the first monomers corresponding to the same arch rib segment are flush.

Further, comprising a second monomer, a first end and a second end of the second monomer form the concave part for interposing the convex part.

A second object of the present invention is to provide an arch bridge, comprising a socket assembled arch rib as described above.

A third object of the present invention is to provide a manufacturing method of a socket assembled arch rib, comprising the steps of:

- sleeving an outer tube to the outside of an inner tube and such that a first end of the inner tube is exposed to a first end of the outer tube and a second end of the inner tube is located inside the outer tube;
- probing a mold into the outer tube through a second end of the outer tube and against the second end of the inner tube, and pouring concrete between the outer tube and the mold and between the outer tube and the inner tube; and
- making the outer tube and the inner tube relatively fix, removing the mold after completion of concrete curing to form a concave part, and obtaining a first monomer.

A fourth object of the present invention is to provide a construction method of a socket assembled arch rib, comprising the steps of:

- socketing a convex part of a first monomer into a concave part of an adjacent first monomer to connect inner tubes and filling the inner tubes with concrete;
- connecting all the first monomers in series in turn and filling with concrete to form an arch rib after the jointing; and
- connecting a first end and a second end of the arch rib respectively to an arch seat.

Further, when filling concrete, anchor members are buried at docking positions of the inner tubes of the adjacent first monomers.

Compared with the prior art, the present invention has the advantages and positive effects of:

(1) For the current problem of unfilled concrete area inside the CFST structure arch rib, resulting in insufficient strength of the arch rib, the present invention adopts a double-layer CFST monomer with convex and concave parts formed respectively at the end, and the adjacent monomers are connected with each other through the socket-fit of the convex and concave parts, which is convenient for the sub-monomers to fill the concrete in the steel tube, ensuring dense concrete filling, reducing unfilled area, and ensuring the strength of the CFST arch rib.

(2) according to the present invention, adopting a monomeric socketing structure for sequential assembly, and filling the internal concrete in segments, which ensures that the internal concrete is completely filled, so that the internal concrete and the inner and outer tubes may be closely fitted to maintain the strength of the whole monomer, thus improving the performance of the monomer.

(3) according to the present invention, a shape of a cross-section of the convex part is of non-circular, and the shape of the cross-section of the convex part is the same as that of the inner tube, so that it can be socketed together and the joint can be jointly stressed; the non-circular section can limit the relative rotation of the convex part and the concave part, which can prevent the rotation or misalignment between the adjacent monomers during multi-segment installation and ensure the installation stability thereof and facilitate fixed installation.

(4) according to the present invention, adopting the double-layer CFST monomer, the monomer can be prefabricated and processed in the project, and the construction speed is accelerated by on-site splicing; and the segment is a double-layer steel tube, with pre-filled concrete between the inner and outer tubes, so that the form can be maintained during on-site assembly and the deformation during arch formation can be reduced, and the inner tubes are filled with concrete after assembly to form a solid CFST structure, and the strength and stiffness can be effectively improved.

(5) according to the present invention, a convex part is formed at a first end of the inner tube to fit a concave part formed after filling the outer tube with the concrete. An anchor member can be pre-buried during the convex part fitting with the concave part to improve the connection strength between adjacent monomers; meanwhile, the concrete filling inside the inner tube can achieve reinforcement, which can increase the connection strength between the anchor member and the inner tube, ensure the friction and bond between the internal concrete and the inner tube, and improve its durability and resistance to overturning and earthquake.

BRIEF DESCRIPTION OF THE DRAWINGS

The accompanying drawings constituting a part of the present invention are used to provide a further understanding of the present invention. The exemplary examples of the present invention and descriptions thereof are used to explain the present invention, and do not constitute an improper limitation of the present invention.

In figures, 1—outer tube, 2—inner tube, 3—anchor member, 4—connection member, 5—convex part, 6—concave part, 7—web member.

DETAILED DESCRIPTION

Example 1

An exemplary example of the present invention, as shown in FIGS. 1-7, provides a socket assembled arch rib.

Figure 1:
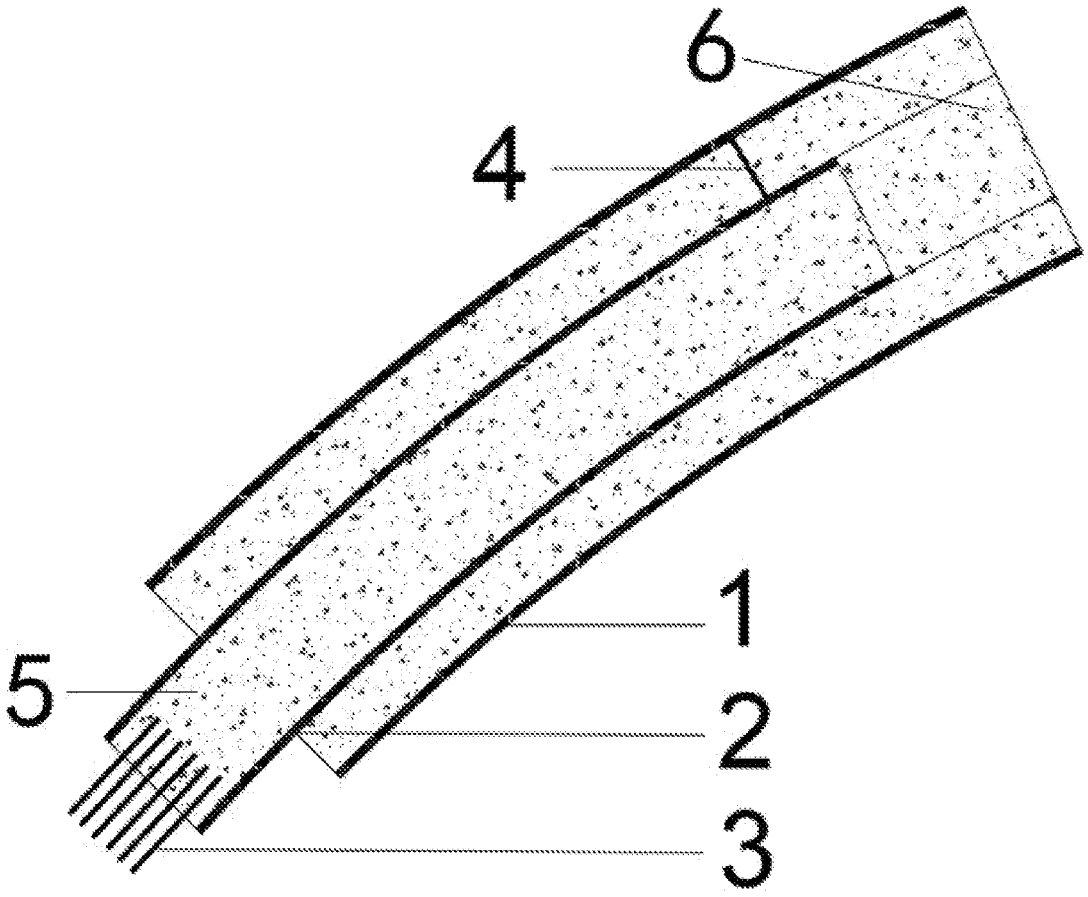
FIG. 1 is a schematic diagram of a first monomer in one or more examples of the present invention.
Figure 2:
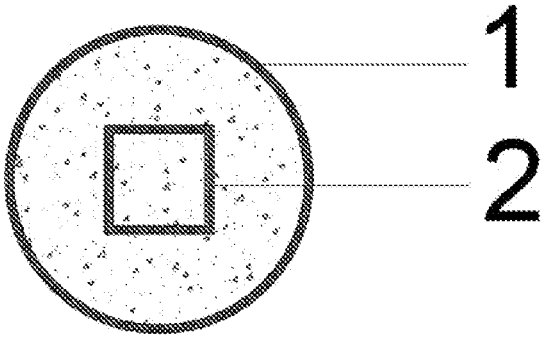
FIG. 2 is a schematic diagram of a radial cross-section of the first monomer in one or more examples of the present invention.

A socket assembled arch rib, as shown in FIG. 1, being composed of a plurality of prefabricated segments connected for a CFST arch bridge. The socket assembled arch rib mainly comprises a first monomer and a second monomer, and a plurality of the first monomers are socketed in series in turn to form a main body of the arch rib, and ends thereof are fitted with the second monomer to realize the docking of the main body of the arch rib with an arch seat.

As shown in FIG. 1, the socket assembled arch rib comprises at least one the first monomer, the first monomer is a sleeving structure of an inner tube 2 and an out tube 1, the outer tube 1 is sleeved outside the inner tube 2, and a first end of the inner tube 2 is protruding outside a first end of the outer tube 1, a part of the inner tube 2 protruding from the outer tube 1 forms a convex part 5, a second end of the inner tube 2 is located inside the outer tube 1, the outer tube 1 is filled with concrete which forms a concave part 6 at a second end of the outer tube 1, the concave part 6 can be socketed and fit with the convex part 5 of the other first monomer, making the two first monomers connected.

The outer tube 1 and the inner tube 2 are made of metal tubes which meet the actual construction requirements, such as steel tubes, etc., and sizes and materials, etc. thereof are reasonably configured according to the needs of the arch ribs.

The outer tube 1 is filled with concrete and the concave part 6 is formed at the second end thereof. The concrete can be filled between the outer tube 1 and the inner tube 2, or it can fill the area of the outer tube 1 and the inner tube 2 and keep the concave part 6 at the second end of the outer tube 1. In the present example, the inner tube 2 is used as a channel for filling concrete after assembly construction, and before an assembly of the first monomer, the concrete is filled between the inner tube 2 and the outer tube 1, an inside of the inner tube 2 is reserved with a channel, and the concave part 6 is communicated with the inner tube 2 to facilitate the communication of the inner tube 2 of the adjacent first monomer after the subsequent socket-fit of the convex part 5 and the concave part 6.

The concave part 6 and the convex part 5 can fit together, and the two are shaped to fit together, so that the concave part 6 and the convex part 5 can be socket-fitted by controlling a cross-section of the concave part 6 in the radial direction of the outer tube 1 to be the same as the cross-section of the inner tube 2 in the radial direction; an end face of the second end of the inner tube 2 located inside the outer tube 1 faces the concave part 6, and after the socket, the end faces of the inner tubes 2 of the two first monomers butt against each other, so that their butt positions fit together and contact.

When a plurality of the first monomers are continuously fitted and socketed for use, the first monomers are sequentially socketed with the adjacent first monomers. In order to ensure the stability of the socket-fit and maintain the form after the socket, the convex part 5 and the concave part 6 adopt a non-circular cross-section, taking the structure shown in FIGS. 1 and 2 as an example, the inner tube 2 adopts a square tube with a rectangular cross-section to form the convex part 5 with a rectangular cross-section, and the corresponding concave part 6 is also configured with a rectangular cross-section, which can limit the mutual rotation of the concave part 6 and the convex part 5 after fitting, thus maintaining the relative position and attitude of the two adjacent second monomers.

In other examples, other non-circular cross-section tubes, such as oval, triangular, hexagonal, and other cross-sectional shapes of tubing, can be selected to form the convex part 5 with non-circular cross-section, and the concave part 6 is provided with the non-circular cross-sectional groove structure that fits with the convex part 5 to achieve torsion and deflection resistance after the convex part 5 fits with the concave part 6.

Additionally, the convex part 5 has a non-circular cross-sectional shape, and the cross-sectional shape of the convex part 5 is the same as the cross-sectional shape of the inner tube 2, which enables the socket-fit to be made and the connection to be jointly stressed; the non-circular cross-sectional shape can limit the relative rotation of the convex part 5 and the concave part 6, which can prevent rotation or misalignment between adjacent monomers during the installation of multiple segments, ensuring installation stability thereof and facilitating the fixed installation.

Concrete is filled between the inner tube 2 and the outer tube 1, which can maintain the relative position of the inner tube 2 and the outer tube 1. In order to facilitate the filling of concrete between the inner tube 2 and the outer tube 1, and to assist in maintaining the relative position of the outer tube 1 and the inner tube 2, a space is provided between the inner tube 2 and the outer tube 1 in the circumferential direction, and a connection member 4 is provided in the space to maintain the relative position of the inner tube 2 and the outer tube 1.

The connection member 4 can be a structure of steel bars, rods, ribs, etc., which can keep the relative position of the inner tube 2 and the outer tube 1 and avoid the position shift of the inner tube 2 and the outer tube 1 when filling the concrete; or, other structures of the connection member 4 can be used.

For the selection of the number of the connection member 4, the configuration can be made according to the demand, such as one, two or more; in order to reduce the obstruction of the connection member 4 to the filling concrete, the number of arrangements of connection member 4 is minimized on the basis of being able to maintain the relative positions of the inner tube 2 and the outer tube 1.

After the socket of the first monomer and the adjacent first monomer, the inner tubes 2 of the two first monomers are communicated with each other and the concrete is filled into the communicated inner tube 2 so that a connection is formed between the filled concrete and an inner wall of the inner tube 2. The filled concrete here is different from the concrete filled during prefabrication of the first monomer, where the concrete is filled into the inner tube 2 during assembly of the first monomer, that is, concrete is filled into the inner tube 2, and concrete is filled between the outer tube 1 and the inner tube 2, which are carried out independently.

When a plurality of first monomers is used in combination and connected by socketing, the connection can be formed by the concrete filled in the inner tube 2. In order to further improve the connection strength between the adjacent first monomers, at least one end of the inner tube 2 is provided with an anchor member 3, a first end of the anchor member 3 is located inside the inner tube 2, and a second end of the anchor member 3 extends to the outside of the inner tube 2, which is fitted with the concrete filled with the inner tube 2 of other first monomers, so that the adjacent first monomers can be stably connected and the connection strength can be improved.

The anchor member 3 can adopt the structure of anchor reinforcement, anchor rod, anchor cable, etc., to connect the concrete inside the inner tubes of the adjacent first monomers, thus realizing the connection of the adjacent first monomers.

Figure 4:
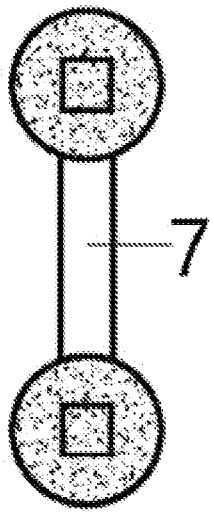
FIG. 4 is a schematic diagram of the first monomer forming an arch rib segment in one or more examples of the present invention.
Figure 5:
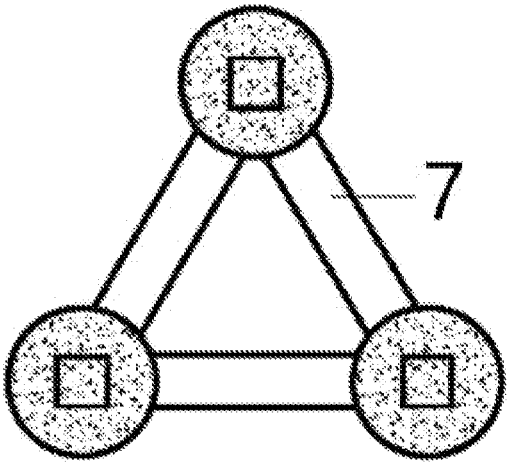
FIG. 5 is a schematic diagram of the first monomer forming an arch rib segment in one or more examples of the present invention.
Figure 6:
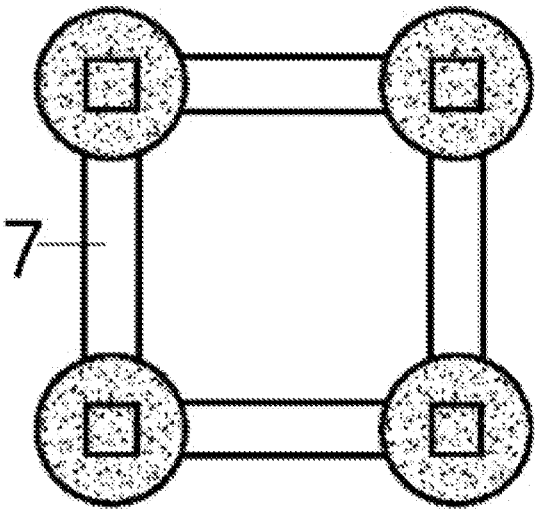
FIG. 6 is a schematic diagram of the first monomer forming an arch rib segment in one or more examples of the present invention.

As shown in FIGS. 4-7, a plurality of first monomers are connected through web members 7 on side surfaces to form an arch rib segment, and end faces of the first monomers corresponding to the same arch rib segment are flush. As shown in FIG. 4, the arch rib segment is formed by connecting the web member 7 between two first monomers; or, as shown in FIG. 5, a triangular cross-sectional arch rib segment is formed by connecting three arch ribs in sequence through the web members 7; or, as shown in FIG. 6, a rectangular cross-sectional arch rib segment is formed by connecting four arch ribs in sequence through the web members 7, then adopting a plurality of arch rib segments to be connected in sequence to form the arch rib.

Figure 7:
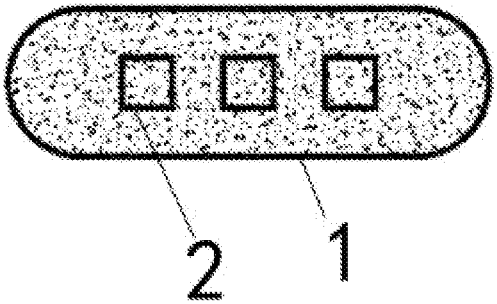
FIG. 7 is a schematic diagram of the first monomer forming an arch rib segment in one or more examples of the present invention.

In other examples, as shown in FIG. 7, a plurality of the inner tubes 2 can also be provided inside the outer tube 1, and the plurality of inner tubes 2 are arranged at intervals to form a plurality of the convex parts 5 and to cooperate with a plurality of the concave parts 6 formed by the outer tube 1.

Figure 3:
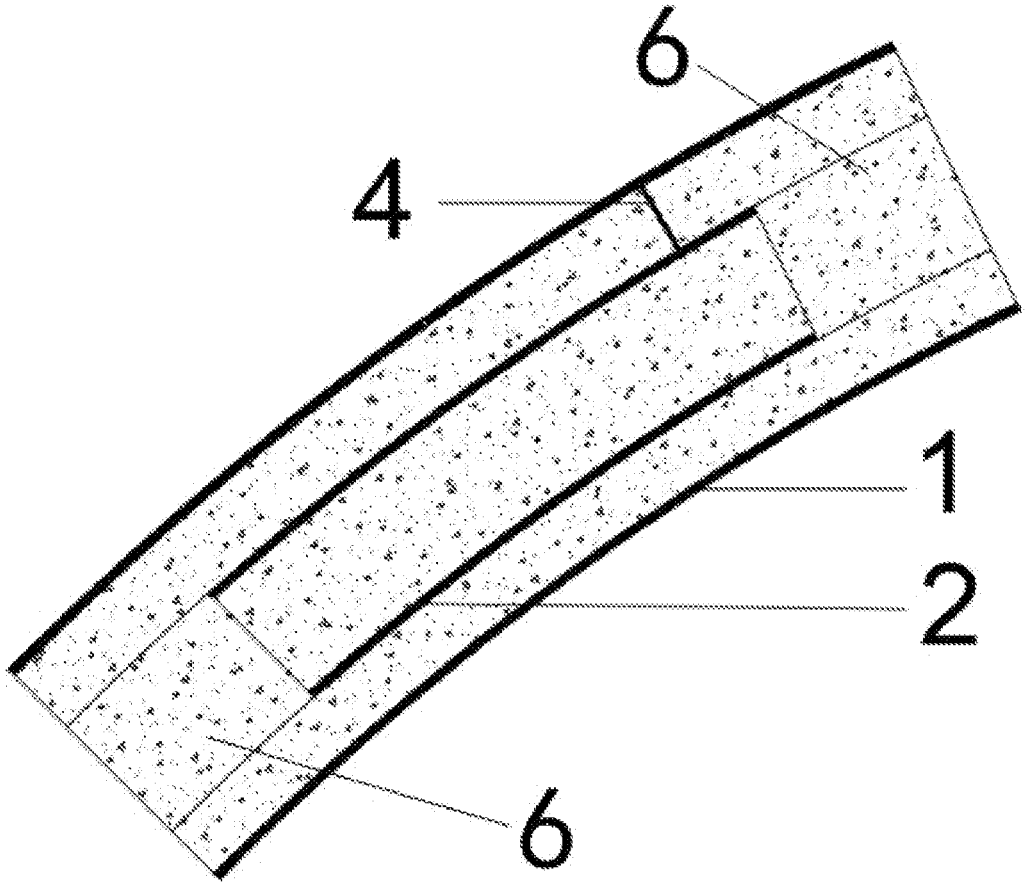
FIG. 3 is a schematic diagram of a second monomer in one or more examples of the present invention.

As shown in FIG. 3, because the first end and the second end of the first monomer are the concave part 6 and the convex part 5, respectively, the main body of the arch rib formed after connecting the first monomers in series in turn needs to be connected to an arch seat, and the connection tendons projecting from the surface are often reserved on the arch seat structure, therefore, in the present example, a second monomer is further provided, and the second monomer is similar in shape to the first monomer, both of which are formed by the inner tube 2 and the outer tube 1 and combined with concrete, but a first end and a second end of the second monomer are the concave parts 6.

The concave part 6 of the first end of the second monomer is connected to the convex part 5 of the first monomer, and the concave part 6 of the second end of the second monomer is socketed into the reserved structure on the arch seat. The first monomers and the second monomers form the arch rib together and can be connected with the arch seat.

Accordingly, adopting the monomeric socketing structure for sequential assembly, filling the internal concrete in segments, ensure that the internal concrete is completely filled, so that the internal concrete and the inner tube 2 and the outer tube 1 can all fit closely together and maintain the strength of the whole monomer, thus improving the performance of the monomer.

Example 2

Another example of the present invention, as shown in FIGS. 1-7, provides an arch bridge.

The arch bridge adopts the socket assembled arch rib as in Example 1, and the socket assembled arch rib connects the arch seat of the arch bridge; for the detailed structure of the socket assembled arch rib see Example 1. Since the arch bridge adopts the socket assembled arch rib provided in Example 1 above, the beneficial effect of the arch bridge brought by the socket assembled arch rib is referred to the corresponding part in Example 1 above, and will not be repeated here.

For the other structures of the arch bridge not mentioned, the existing structure can be used.

Example 3

Another example of the present invention, as shown in FIGS. 1-7, provides a manufacturing method of a socket assembled arch rib.

The manufacturing method of the socket assembled arch rib is used to manufacture the socket assembled arch rib as in Example 1, comprising the steps of:

sleeving an outer tube 1 to an outside of an inner tube 2 and such that a first end of the inner tube 2 is exposed to a first end of the outer tube 1 and a second end of the inner tube 2 is located inside the outer tube 1;

probing a mold into the outer tube 1 through a second end of the outer tube 1 and against the second end of the inner tube 2, and pouring concrete between the outer tube 1 and the mold and between the outer tube 1 and the inner tube 2; and making the inner tube 2 and the outer tube 1 relatively fix, removing the mold after completion of concrete curing to form a concave part 6, and obtaining a first monomer.

Specifically:

sleeving the inner tube 2 and the outer tube 1 to form a double-layer tubular structure and fixing a relative position of the inner tube 2 and the outer tube 1 by welding a connection member 4;

making a casting template according to the outer tube 1 and the inner tube 2 and a dimension of a monomer formed thereby to facilitate the forming of the concave part 6 of the monomer; and fixing the outer tube 1 and the inner tube 2 for pouring of a prefabricated component, and after the completion of the pouring, demolding to form the monomer.

It should be noted that in making the first monomer, the template is probed into the second end of the outer tube 1 to form the first monomer with the concave part 6 at the second end and a convex part 5 at the first end after demolding; in making a second monomer, the template is probed into both ends of the outer tube 1 to form the second monomer with the concave parts 6 at both ends after demolding.

The convex part 5 is formed at the first end of the inner tube 2 to fit the concave part 6 formed after filling the outer tube 1 with concrete, the anchor member 3 can be pre-buried in the convex part 5 when the convex part 5 is fitted with the concave part 6 to improve the connection strength between adjacent monomers; meanwhile, the concrete filling inside the inner tube 2 can achieve reinforcement, which can increase the connection strength between the anchor member 3 and the inner tube 2, ensure the friction and bond between the internal concrete and the inner tube 2, and improve its durability and resistance to overturning and earthquake.

Example 4

A further typical example of the present invention, as shown in FIGS. 1-7, provides a construction method of a socket assembled arch rib.

Carrying out the construction of based on the socket assembled arch rib as in Example 1, comprising the steps of:

inserting a certain number of anchoring reinforcement bars being extended out a certain length when concrete is poured into the arch seats on both sides during the construction of the arch seat;

socketing a concave part 6 of a first monomer into the arch seat on one side, and the anchoring reinforcement bars on the arch seat are inserted into the concave part 6 of the first monomer, carrying out grouting the inside to reinforce the connection;

socketing a convex part 5 of the present first monomer into the concave part 6 of an adjacent first monomer so that inner tubes 2 are communicated and filled with concrete inside the inner tubes 2; while filling the concrete, burying an anchor member 3 at a docking position of the inner tubes 2 of the adjacent first monomers; and sequentially socketing all the first monomers in series and filling them with concrete to form a main body of an arch rib; socketing the convex part 5 at the end of the main body of the arch rib into the concave part 6 at a first end of the second monomer, and socketing the concave part 6 at a second end of the second monomer into the arch seat on the other side, carrying out grouting the inside to reinforce the connection, and forming the arch rib after the jointing.

Accordingly, adopting the double-layer CFST monomer, the monomer can be prefabricated and processed in the project, and the construction speed is accelerated by on-site socketing; moreover, the segment is a double-layer steel tube, with pre-filled concrete between the inner tube 2 and the outer tube 1, so that the form can be maintained during on-site assembly and the deformation during arch formation can be reduced, and the inner tube 2 is filled with concrete after assembly to form a solid CFST structure, and the strength and stiffness can be effectively improved.

The above examples are the preferred embodiments of the present invention, and are not intended to limit the present invention. For those skilled in the art, the present invention can have various changes and variations. Any modification, equivalent replacement, improvement, etc. made within the spirit and principle of the invention shall be included in the protection scope of the present invention.

What is claimed is:

1. A socket assembled arch rib, comprising at least one first monomer, the first monomer comprises an inner tube and an outer tube snapped outside the inner tube, a first end of the inner tube protrudes from a first end of the outer tube to form a convex part, a second end of the inner tube is located in the outer tube, the outer tube is filled with concrete, and the concrete forms a concave part at a second end of the outer tube for socketing the convex part of the other first monomer.

2. The socket assembled arch rib according to claim 1, wherein a cross-section of the concave part along a radial direction of the outer tube is the same as a cross-section of a radial direction of the inner tube, and the concave part fits the convex part to limit rotation of the inner tube about an axis thereof.

3. The socket assembled arch rib according to claim 1, wherein a space is provided between the inner tube in a circumferential direction and the outer tube, and a connecting piece is provided within the space to maintain a relative position of the inner tube and the outer tube.

4. The socket assembled arch rib according to claim 1, wherein the inner tube is filled with concrete and the space between the inner tube and the outer tube is filled with concrete.

5. The socket assembled arch rib according to claim 4, wherein at least one end of the inner tube is provided with an anchor member, a first end of the anchor member being located inside the inner tube and a second end extending outside the inner tube.

6. The socket assembled arch rib according to claim 1, wherein further comprising a second monomer, a first end and a second end of the second monomer form the concave part for interposing the convex part.

7. An arch bridge, comprising a socket assembled arch rib according to any one of claims 1 to 6.

8. A manufacturing method of a socket assembled arch rib according to any one of claims 1 to 6, comprising the steps of:

sleeving an outer tube to the outside of an inner tube and such that a first end of the inner tube is exposed to a first end of the outer tube and a second end of the inner tube is located inside the outer tube;

probing a mold into the outer tube through a second end of the outer tube and against the second end of the inner tube, and pouring concrete between the outer tube and the mold and between the outer tube and the inner tube; and making the outer tube and the inner tube relatively fix, removing the mold after completion of concrete curing to form a concave part, and obtaining a first monomer.

9. A construction method of a socket assembled arch rib according to any one of claims 1 to 6, comprising the steps of:

socketing a convex part of a first monomer into a concave part of an adjacent first monomer to connect inner tubes and filling the inner tubes with concrete;

connecting all the first monomers in series in turn and filling with concrete to form an arch rib after the jointing; and connecting a first end and a second end of the arch rib respectively to an arch seat.

10. The construction method according to claim 9, wherein, when filling concrete, an anchor member is buried at a docking position of the inner tubes of the adjacent first monomers.

* * * * *